US008365744B1

(12) United States Patent
Branch

(10) Patent No.: US 8,365,744 B1
(45) Date of Patent: Feb. 5, 2013

(54) HAIR CUTTING DESIGN KIT

(76) Inventor: Donell Branch, Colorado Springs, CO (US)

( * ) Notice: Subject to any disclaimer, the term of this patent is extended or adjusted under 35 U.S.C. 154(b) by 0 days.

(21) Appl. No.: 13/190,963

(22) Filed: Jul. 26, 2011

(51) Int. Cl.
*A45D 7/00* (2006.01)
*A45D 24/34* (2006.01)

(52) U.S. Cl. ..... 132/200; 132/213

(58) Field of Classification Search ..... 132/319, 132/213, 200; 30/233
See application file for complete search history.

(56) References Cited

U.S. PATENT DOCUMENTS 3,433,232 A * 3/1969 Garrett ..... 132/208
3,972,075 A * 8/1976 Alevras ..... 2/174
4,977,672 A * 12/1990 Hamilton ..... 30/233
5,329,946 A 7/1994 Guma
5,427,122 A 6/1995 Hamilton
5,494,057 A 2/1996 Gianfrancesco
5,664,590 A * 9/1997 Plateroti et al. ..... 132/270
7,559,331 B2 7/2009 Ward
2004/0074511 A1 4/2004 Sussan
2005/0000536 A1* 1/2005 Notorio ..... 132/213
2005/0205105 A1* 9/2005 Demko ..... 132/214
2007/0295351 A1* 12/2007 Germer ..... 132/200

* cited by examiner

*Primary Examiner* — Robyn Doan
(74) *Attorney, Agent, or Firm* — Timothy M. Barlow

(57) ABSTRACT

A kit for creating decorative haircut designs includes a hair design stencil that, when held against a subject body of hair, at least partly defines a desired haircut design, and at least partly bounds a region of hair to be decoratively cut, said stencil having a flexible panel, wherein selected portions of the panel are removed to define the at least parts of the desired haircut design; a hair marking compound that is applied to the hair defined by the hair design stencil; and hair clippers for cutting the desired haircut design according to the applied hair marking compound. The kit may include a stencil frame for releasably holding the stencil near the edges, and wherein the stencil frame includes a handle. The hair design stencil may be a plastic or paper sheet, and multiple stencils may be used simultaneously or sequentially. Multiple marking compound colors may be used.

6 Claims, 4 Drawing Sheets

HAIR CUTTING DESIGN KIT

FIELD OF THE INVENTION

The present invention relates to items and methods for cutting hair and, in particular, methods and a kit for creating desired designs with a haircut.

BACKGROUND OF THE INVENTION

Various designs are seen cut into hair today. Many of these special haircut styles are intended to create an image to be displayed. Some of such haircut styles include a very close or very short hair length with various designs or decorations formed in the hair by removing any undesired hair right down to the scalp. This creates a decorative layout where the contrast between the bare scalp and the surrounding hair brings the decorative designs into view. However, the quality of such decorative designs varies greatly depending on the skill of the hair stylist or barber.

Numerous tools have been introduced over the years for the purpose of aiding the hair stylist or barber (hereinafter stylist) in performing their services. These tools include neck and face shaving patterns or guides, hair-cutting guides for bangs or to aid in trimming the ends of long hair, and tools for sculpting hair to various shapes.

Known tools and methods for creating desired designs in a haircut have several inadequacies. For example, as mentioned above, prior tools and methods rely almost solely upon the skill and experience of the stylist. Further, many of the tools have little or no ability to be moved to a different location upon the head or even to a different location on the body.

It is an object of the present invention to provide a kit and improved methods for creating a decorative design in a haircut.

SUMMARY OF THE INVENTION

According to one aspect of the invention, there is provided a kit for creating decorative haircut designs, said kit including a) a hair design stencil that, when held against a subject body of hair, at least partly defines a desired haircut design, and at least partly bounds a region of hair, which may be a subset of the subject body of hair, to be decoratively cut, said hair design stencil having a flexible panel, wherein selected portions of the flexible panel are removed to define the at least parts of the desired haircut design; b) a hair marking compound that is applied to the subject body of hair defined by the hair design stencil; and c) a hair clippers for cutting the desired haircut design according to the applied hair marking compound. Such a kit provides a distinct advantage over the conventional art in that it significantly reduces, or eliminates, the necessary skills or experience of the stylist in making the desired haircut design.

According to an embodiment of the invention, the kit further includes a stencil frame, wherein the stencil frame releasably holds the hair design stencil near its edges, and wherein the stencil frame includes a handle for better control of the hair design stencil. The frame and handle provide positive control options for the stylist in placing the stencil against the body of hair, such as a customer's head. Thus, a perfect placement and orientation may be determined more objectively, without the stylist's hand being in the way.

According to a further embodiment of the invention, the hair design stencil is made from a plastic sheet. This provides the advantage of a stencil that is strong and flexible and that can be cleaned and re-used. Further, new designs can be made quickly and easily.

According to another embodiment of the invention, the hair design stencil is made from a paper sheet. This provides the advantage of a stencil that is inexpensive and can be recycled. Further, new designs can be made quickly and easily.

According to a further embodiment of the invention, the hair design stencil may include two or more sheets, each sheet including a portion of the desired haircut design. That is, a single decorative haircut design may include two or more design stencils. The stencils may be used simultaneously or sequentially. This arrangement provides advantages for the application of large or complex designs, which are too long, wide or large for a single stencil sheet, or which are complex designs which require 'layering' of multiple stencils to accurately reproduce the decorative haircut design.

According to another embodiment, the hair marking compound includes a talcum powder compound. The talcum powder provides an advantage in that it is commonly present and available in hair styling salons and barber shops. In addition, it is non-toxic and easy to remove.

According to a further embodiment, the hair marking compound includes a hair colorant. A hair colorant provides an advantage of a distinct color contrast which is easy for the stylist to see, and which may be a desirable color for the customer. The colorant may be easily removed or semi-permanent, such as known hair coloring compounds.

According to another embodiment, the hair marking compound includes a dry powder. A dry powder offers an advantage in that it is easy to clean up, such as with a vacuum or by gentle brushing.

According to a further embodiment, the kit further includes an aerosol spray applicator. The aerosol spray applicator provides an advantage in that the stylist may quickly apply the hair marking compound in a few quick passes. The aerosol spray applicator may be used with dry powder or liquid-type hair marking compounds.

According to another embodiment, the kit further includes an applicator brush for applying the hair marking compound. The applicator brush provides an advantage in that the stylist may quickly brush the hair marking compound onto the subject hair in a few quick strokes. The applicator brush may be used with dry powder or liquid-type hair marking compounds.

According to another aspect of the invention, there is provided a method of using a kit for creating a decorative haircut design, the kit including a hair design stencil that, when held against a subject body of hair, at least partly defines a desired haircut design, and at least partly bounds a region of hair to be decoratively cut, said hair design stencil having a flexible panel, wherein selected portions of the flexible panel are removed to define the at least parts of the desired haircut design; a hair marking compound that is applied to the subject body of hair defined by the selected portions of the flexible panel which are removed to define the at least parts of the desired haircut design, e.g., the hair design stencil; and a hair clippers for cutting the desired haircut design according to the desired haircut design having the applied hair marking compound, said method steps comprising:

1) holding the hair design stencil against the subject body of hair to at least partly define a desired haircut design on a region of hair to be decoratively cut:

2) applying the hair marking compound to the subject body of hair defined by the hair design stencil; and 3) cutting the desired haircut design according to the applied hair marking compound.

According to an embodiment of the invention, the step of applying the hair marking compound includes brushing the hair marking compound onto the subject body of hair defined by the hair design stencil.

According to another embodiment of the invention, the step of applying the hair marking compound includes spraying the hair marking compound onto the subject body of hair defined by the hair design stencil.

According to a further embodiment of the invention, the step of holding the hair design stencil against the subject body of hair includes holding two or more said hair design stencil sheets simultaneously, each sheet including a portion of the desired haircut design, to create a complete haircut design.

According to another embodiment of the invention, the step of holding the hair design stencil against the subject body of hair includes holding two or more said hair design stencil sheets sequentially, each sheet including a portion of the desired haircut design, to create a complete haircut design.

The kit according to the present invention facilitates the creation of neat and precise decorative hair designs.

BRIEF DESCRIPTION OF THE DRAWINGS

These and other advantages of the invention will become apparent upon reading the following detailed description and upon referring to the drawings in which.

Figure 1:
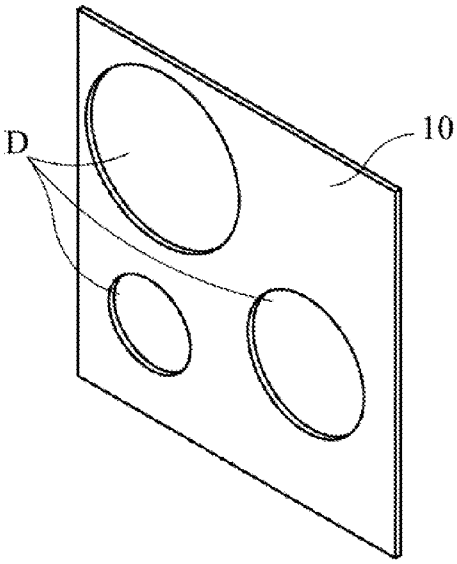
FIG. 1 illustrates is a perspective view of a hair design stencil of a kit for creating decorative haircut designs, according to an embodiment of the invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

A hair design stencil 10 for a kit 1 for creating decorative haircut designs is illustrated in FIG. 1. The hair design stencil 10 is a sheet that includes a number of apertures D where portions of the sheet are removed, the apertures D having decorative shapes. In FIG. 1, the apertures D are simple circles, but may be any number of different decorative arrangements, including school or sports team logos, various symbols, letters, numbers and abstract designs. The hair design stencils 10 may be plastic or paper sheets, which make it easy to create a new design either on a computer or by drawing directly on the sheets, and thereafter removing material from the sheets to make the desired apertures D necessary for the decorative design of the hair design stencil 10.

Figure 2:
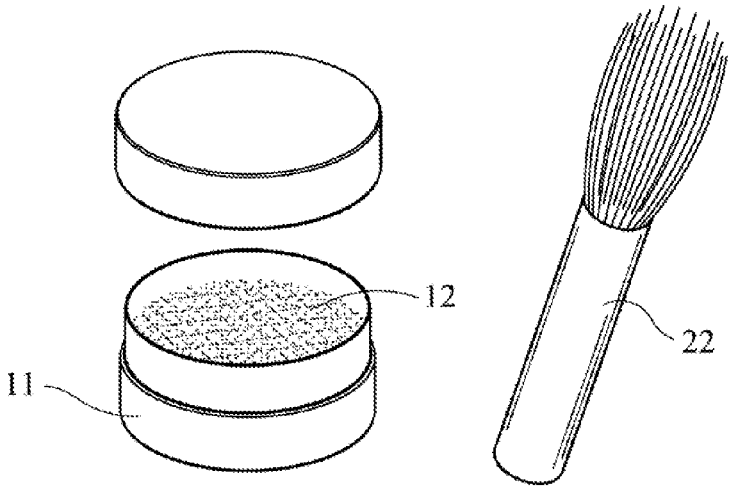
FIG. 2 illustrates a perspective view of a container of a hair marking compound with an applicator brush for a kit for creating decorative haircut designs, according to an embodiment of the invention.
Figure 3:
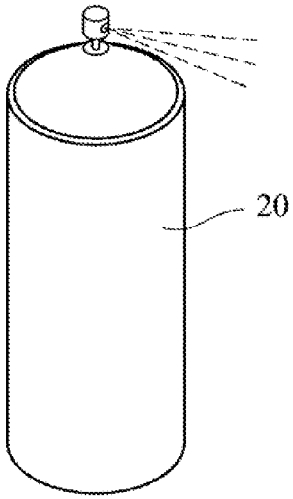
FIG. 3 illustrates a perspective view of hair clippers for a kit for creating decorative haircut designs, according to an embodiment of the invention.

A container 11 of a hair marking compound 12 for a kit 1 for creating decorative haircut designs is illustrated in FIG. 2. The hair marking compound 12 may be a dry powder, such as talcum or baby powder, which may be applied to hair via a brush 22 or similar means. Alternatively, the hair marking compound 12 may be a liquid compound, which can be 'painted' onto the subject hair. As a further alternative, an aerosol applicator 20, as illustrated in FIG. 3, may be used to spray both liquid and/or dry powder hair marking compounds onto the subject hair.

Figure 4:
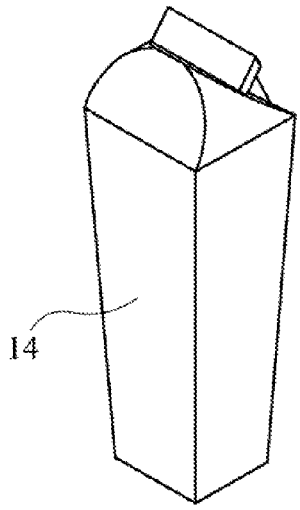
FIG. 4 illustrates a perspective view of a stencil frame for a kit for creating decorative haircut designs, according to an embodiment of the invention.

A hair clippers 14 for a kit 1 for creating decorative haircut designs is illustrated in FIG. 4. The hair clippers 14 may be of the electric variety, with a vibrating or oscillating blade arrangement, and having interchangeable combs for various predetermined hair lengths. The hair clippers 14 permit the user of the kit 1 to very closely follow the desired decorative design defined by the hair stencil 10, and as transferred onto the subject hair by the hair marking compound 12.

Figure 5:
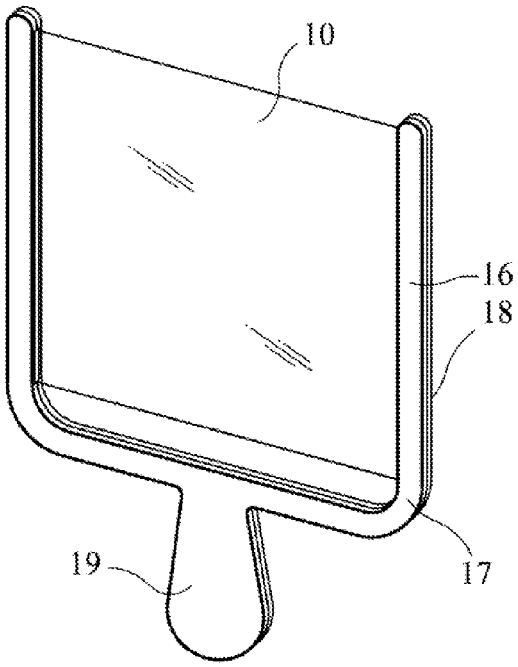
FIG. 5 illustrates an aerosol applicator for a kit for creating decorative haircut designs, according to an embodiment of the invention.

A stencil frame 16 for a kit 1 for creating decorative haircut designs is illustrated in FIG. 5. The stencil frame 16 is designed to hold a hair stencil 10 on or near its edges, such as with friction clamps. As a non-limiting example, the stencil frame 16 may be made from two or more lamina 17, 18 bonded together at a handle section 19. The two lamina may be pulled apart slightly away from the handle 19 to place a hair stencil 10 therebetween. The pinching action of the two lamina 17, 18 of the stencil frame 16 holds the hair stencil 10 securely in the stencil frame 16. A more simple example may include a non-pinching frame which uses ordinary 'binding clips' to hold the hair design stencil 10 to the frame 16. Numerous other arrangements are known.

Figure 6:
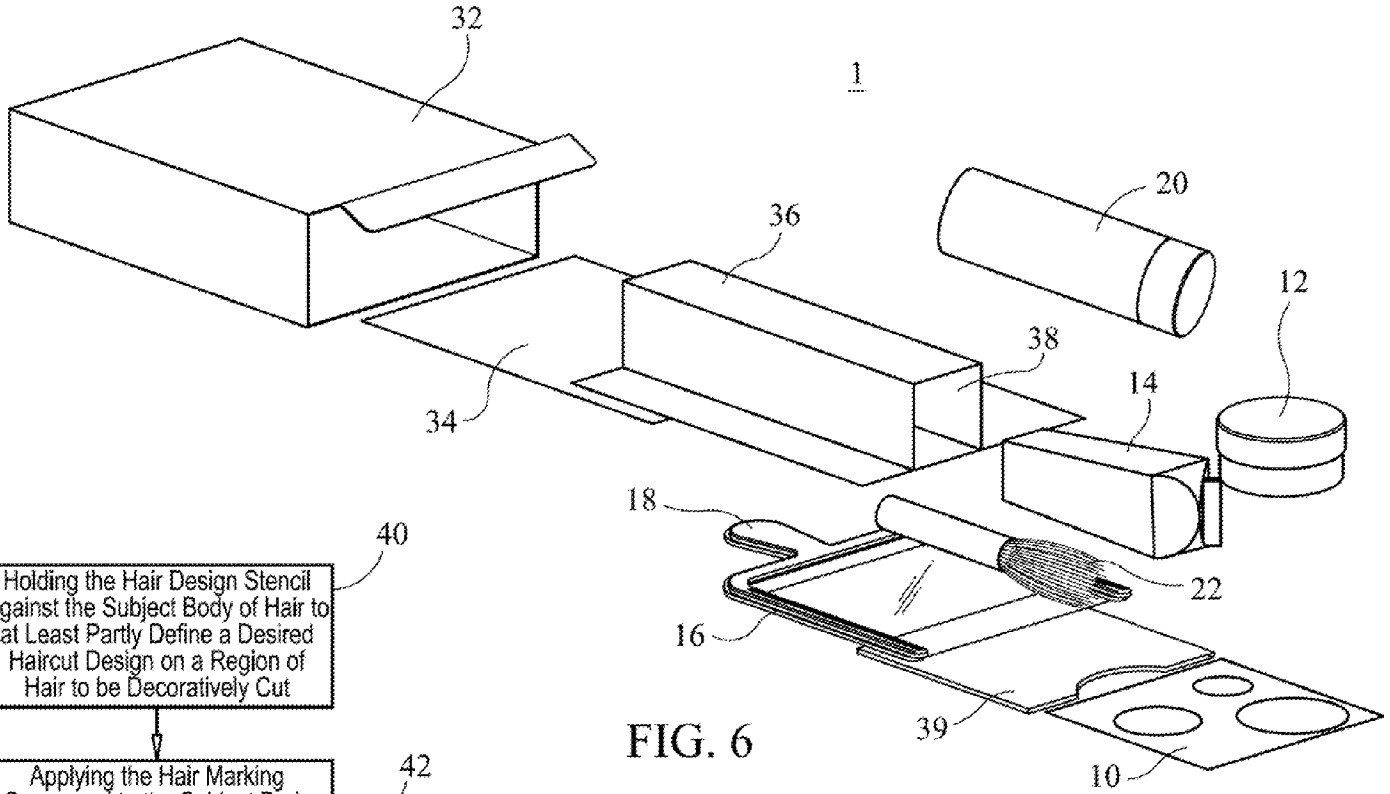
FIGS. 6-7 illustrate method steps for using a kit for creating decorative haircut designs, according to an embodiment of the invention.

An embodiment of a kit 1 for creating decorative haircut designs is illustrated in FIG. 6. The kit 1 may include only those items provided in claim 1, or may be a more comprehensive kit 1 including every element discussed above, in one organized package. The kit 1 may include an instruction sheet 34 which may provide detailed instructions for creating decorative haircut designs. A protective insert 36 may provide a cavity 38 for the clippers 14, and when inserted into an outer box 32, the protective insert 36 may provide or define cavities for the hair marking compound 12, 20, as well as the brush 22, stencil frame 16 and a packet 39 of hair stencils 10. As discussed above, the kit 1 may include everything shown, or may include only a few basic pieces, as defined by the claims.

Figure 7:
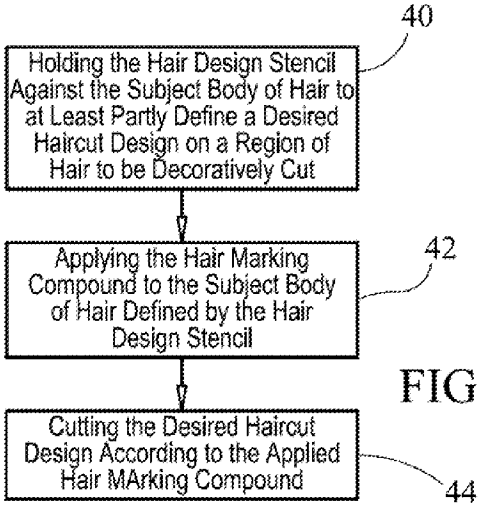
Figure 8:
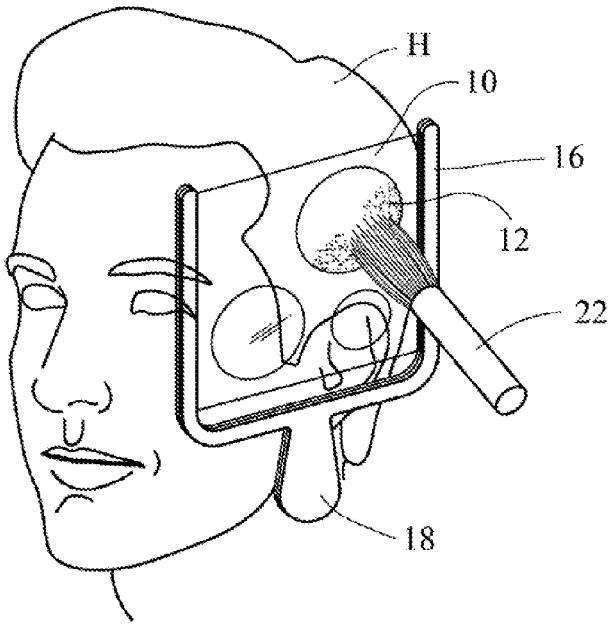
FIG. 8 illustrates an embodiment of a kit for creating decorative haircut designs, according to an embodiment of the invention.
Figure 9:
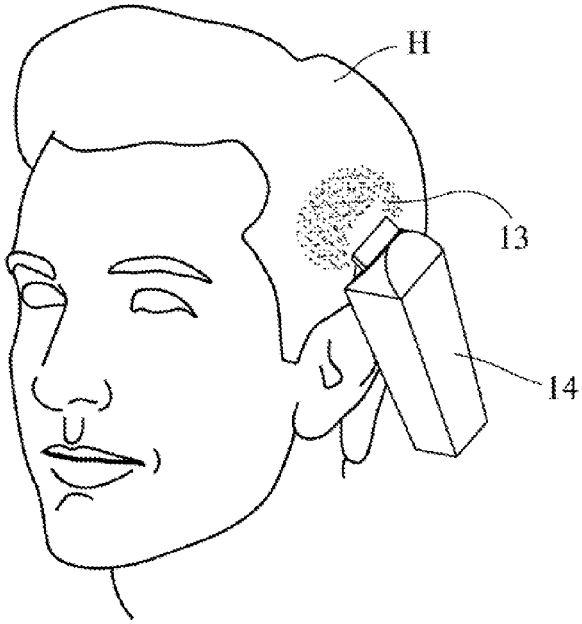
FIG. 9 illustrates an embodiment of a kit for creating decorative haircut designs, according to an embodiment of the invention.

The method for creating decorative haircut designs is provided in FIG. 7. One embodiment of the method of using the kit 1 for creating decorative haircut designs is illustrated in FIGS. 8-9.

Step 1 of the method for creating decorative haircut designs includes holding (step 40) the hair design stencil 10 against the subject body of hair H (see FIG. 8) to at least partly define a desired haircut design on a region of hair to be decoratively cut. It should be made clear that the term hair should be very loosely defined so as to include any person's or animal's hair, and without limit to a particular placement on the body. In addition, any surface or material having a 'hairy' texture, such as fabrics, carpets or even produce, having a nap long enough to cut with electric clippers should be included. FIG. 8 illustrates a hair stencil 10 being held against subject body of hair H, and a brush 22 being used to apply hair marking compound 12, 20. In this non-limiting example, the hair stencil 10 is supported by a stencil frame 16. However, the hair stencil 10 may be supported with a hand instead.

Step 2 of the method for creating decorative haircut designs includes applying (step 42) the hair marking compound 12, 20 to the subject body of hair H defined by the hair design stencil 10. Of course, the hair design stencil 10 has selected portions of the flexible panel which are removed to define the at least parts of the desired haircut design.

Step 3 of the method for creating decorative haircut designs include cutting (step 44) the desired haircut design according to the applied hair marking compound 12, 20. FIG. 9 illustrates an electric clippers 14 being used to selectively cut only the hair H having applied hair marking compound 13. In this non-limiting example, the applied hair marking compound 13 is in the form of a circle, according to the design provided in the stencil 10. However, the disclosure is not limited to solid geometric shapes, but may include any design arrangement which may be represented in one or more stencils.

According to a further embodiment, the step of applying the hair marking compound (step 42) includes brushing the hair marking compound onto the subject body of hair H defined by the selected portions of the flexible panel which are removed to define the at least parts of the desired haircut design. This, of course, defines the stencil 10, in that the portions of the flexible panel or sheet which are removed provide the apertures that define the decorative design.

According to another embodiment, the step of applying the hair marking compound (step 42) includes spraying the hair marking compound onto the subject body of hair defined by the selected portions of the flexible panel which are removed to define the at least parts of the desired haircut design.

According to a further embodiment, the step of holding (step 40) the hair design stencil 10 against the subject body of hair H includes holding two or more said hair design stencil sheets 10, each stencil 10 sheet including a portion of the desired haircut design, to create a complete haircut design. This method is quite useful where the desired decorative design is too large for a single stencil 10 to accurately represent. This method is also useful where a complex decorative design cannot be represented on a single stencil 10.

According to another embodiment, two or more stencils may be used simultaneously or in succession for large or complex designs.

According to a further embodiment, each stencil may be associated with a hair marking compound of a different color. The decorative design may be made by removing, or leaving, only the hair that is marked with a single color, or by removing or leaving the hair that is marked with more than one color. In this manner, highly complex decorative designs can be accurately defined and formed.

Thus, it is apparent that there has been provided in accordance with the invention a haircutting design kit that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim:

1. A method of using a kit for creating a decorative haircut design, the kit including a hair design stencil that, when held against a subject body of hair, at least partly defines a desired haircut design, and at least partly bounds a region of hair to be decoratively cut, said hair design stencil having a flexible panel, wherein selected portions of the flexible panel are removed to define the at least parts of the desired haircut design; a hair marking compound that is applied to the subject body of hair defined by the hair design stencil; and a hair clippers for cutting the desired haircut design according to the desired haircut design having the applied hair marking compound, said method steps in sequence order comprising:

1) holding the hair design stencil against the subject body of hair to at least partly define a desired haircut design on a region of hair to be decoratively cut;
2) applying the hair marking compound to the subject body of hair defined by the hair design stencil;
3) removing the hair design stencil from the subject body of hair; and
4) cutting the desired haircut design according to the applied hair marking compound.

2. The method of using a kit for creating a decorative haircut design of claim 1, wherein the step of applying the hair marking compound includes brushing the hair marking compound onto the subject body of hair defined by the selected portions of the flexible panel which are removed to define the at least parts of the desired haircut design.

3. The method of using a kit for creating a decorative haircut design of claim 1, wherein the step of applying the hair marking compound includes spraying the hair marking compound onto the subject body of hair defined by the selected portions of the flexible panel which are removed to define the at least parts of the desired haircut design.

4. The method of using a kit for creating a decorative haircut design of claim 1, wherein the step of holding the hair design stencil against the subject body of hair includes holding two or more said hair design stencil sheets simultaneously, each sheet including at least a portion of the desired haircut design, to create a complete haircut design.

5. The method of using a kit for creating a decorative haircut design of claim 1, wherein the step of holding the hair design stencil against the subject body of hair includes holding two or more said hair design stencil sheets sequentially, each sheet including at least a portion of the desired haircut design, to create a complete haircut design.

6. The method of using a kit for creating a decorative haircut design of claim 5, wherein the step of applying the hair marking compound to the subject body of hair defined by the hair design stencil includes applying a different color of hair marking compound for each of the two or more design stencils sheets.

* * * * *